United States Patent [19]

Lund

[11] 4,131,066

[45] Dec. 26, 1978

[54] REFERENCE MECHANISM FOR SPIKE DRIVER

[75] Inventor: Raymond R. Lund, West Columbia, S.C.

[73] Assignee: Canron, Inc., New York, N.Y.

[21] Appl. No.: 779,635

[22] Filed: Mar. 21, 1977

[51] Int. Cl.[2] ..... E01B 29/2

[52] U.S. Cl. ..... 104/17 R; 33/1 Q; 104/1 R

[58] Field of Search ..... 104/17 R, 17 A, 1 R, 104/2, 5, 6, 16; 73/105; 33/1 Q

[56] References Cited

U.S. PATENT DOCUMENTS 3,717,101 2/1973 Katcha et al. ..... 104/17 R 3,753,405 8/1973 Bryan, Jr. ..... 104/17 R

*Primary Examiner*—Albert J. Makay

*Assistant Examiner*—Randolph A. Reese

*Attorney, Agent, or Firm*—Wenderoth, Lind & Ponack

[57] ABSTRACT

A reference mechanism for a spike driving machine is disclosed. The spike driving machine has a hole sensing device followed by a spike setter and drive head all of which sweep along a rail tie in a direction parallel to the rail. When the sensing device senses a hole it signals to the reference mechanism which references the hole to the setter and drive head which are following. The sweep continues until the setter and drive head are located over the hole at which point the sweep is stopped by the reference mechanism.

9 Claims, 4 Drawing Figures

REFERENCE MECHANISM FOR SPIKE DRIVER

BACKGROUND OF THE INVENTION

This invention relates to machines for driving spikes through holes in rail tie plates to secure rails to ties.

It is obviously important to locate the tie plate holes accurately and ensure that the spikes are driven accurately through the holes. Various types of sensing devices are available for locating the holes, such as tactile sensors or electro-optical sensors but a problem encountered by all is that it is physically impossible to locate the hole sensor and the drive head at exactly the same position on the machine and so when the sensor locates a hole it is then necessary to move the drive head an appropriate distance so that it becomes positioned over the hole.

Usually a spike setter is provided for setting a spike under the drive head, and this too has to be moved the appropriate distance over the hole.

SUMMARY OF THE INVENTION

The present invention solves this problem by providing a reference mechanism which is actuated when the hole is sensed to reference the drive head (and setter) to the hole.

According to a broad aspect, the present invention provides a spike driving machine for driving spikes through holes in rail tie plates to secure rails to ties, the machine comprising a frame carrying a hole sensor and a spike driving head for driving a spike through a sensed hole in a tie plate, the frame being mounted for movement parallel to the rails on at least one guide rod, means for moving the frame parallel to the rails with the hole sensor leading the drive head, a reference mechanism carried by the frame and being operable on sensing by the hole sensor of a hole from an unclamped condition to a clamped condition in which the reference mechanism is clamped to the guide rod, the frame being arranged to continue its travel until contacts carried by the reference mechanism and frame are closed at which time the drive head is positioned above the hole.

BRIEF DESCRIPTION OF THE DRAWINGS

The invention will now be described in greater detail with reference to the accompanying drawings in which.

DESCRIPTION OF THE PREFERRED EMBODIMENT

Figure 2:
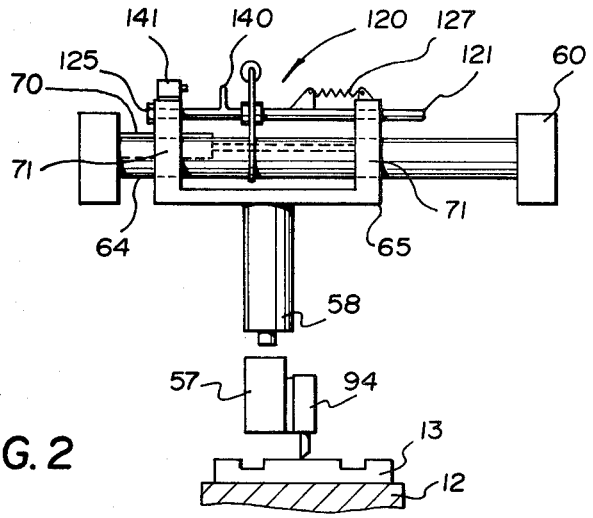
FIGS. 2–4 are 3 diagrammatic views showing the mechanism of FIG. 1 at successive stages of its operation.
Figure 3:
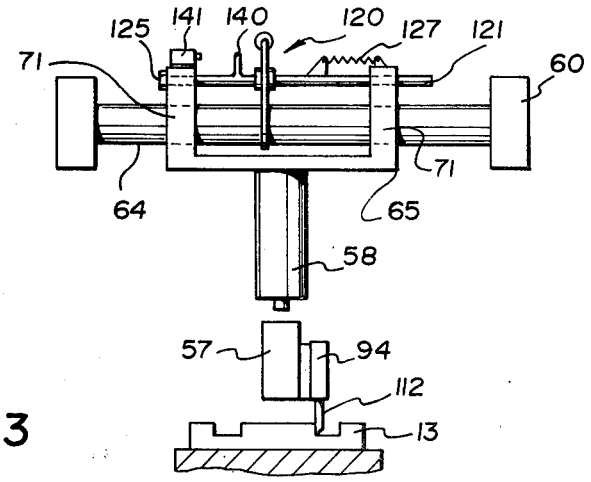
Figure 4:
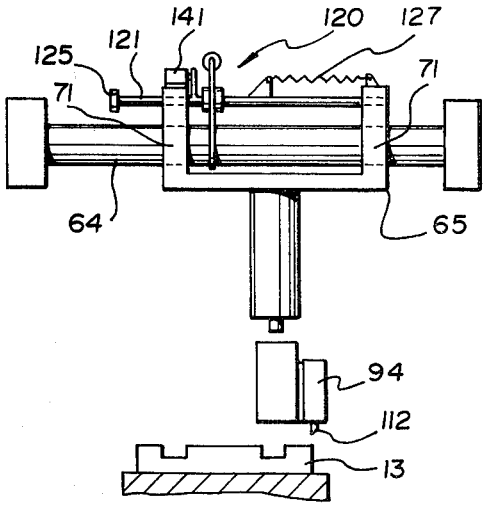

With reference firstly to FIGS. 2–4, a spike holder 57, drive head 58 and hole feeler 94 are mounted on a frame 65 which is movable on rods 64 in a direction parallel to the rails by means of a pneumatic piston and cylinder 70 interconnected between a main work frame 60 carrying rods 64 and the frame 65. The frame 65 is known as a Y-frame as it moves in the longitudinal direction of the rails.

While the Y-frame sweeps along under the action of the piston and cylinder, the finger 112 of the hole feeler 94 traces along the upper surface of the tie plate 13 until it finds a hole in the tie plate at which point it extends into the hole and immediately retracts operating a switch in the hole feeler 94 to indicate the presence of the hole. This operates a Y-reference mechanism described below which references the drive head 58 and setter 57 to the hole position. The Y-frame continues its sweep until the drive head 58 and setter 57 are aligned with the hole as determined by the Y-reference mechanism.

With the Y-frame stopped in this position, the drive head 58 is operated to drive a spike (not shown) held in holder 57 through the tie plate hole previously located and into the tie.

Figure 1:
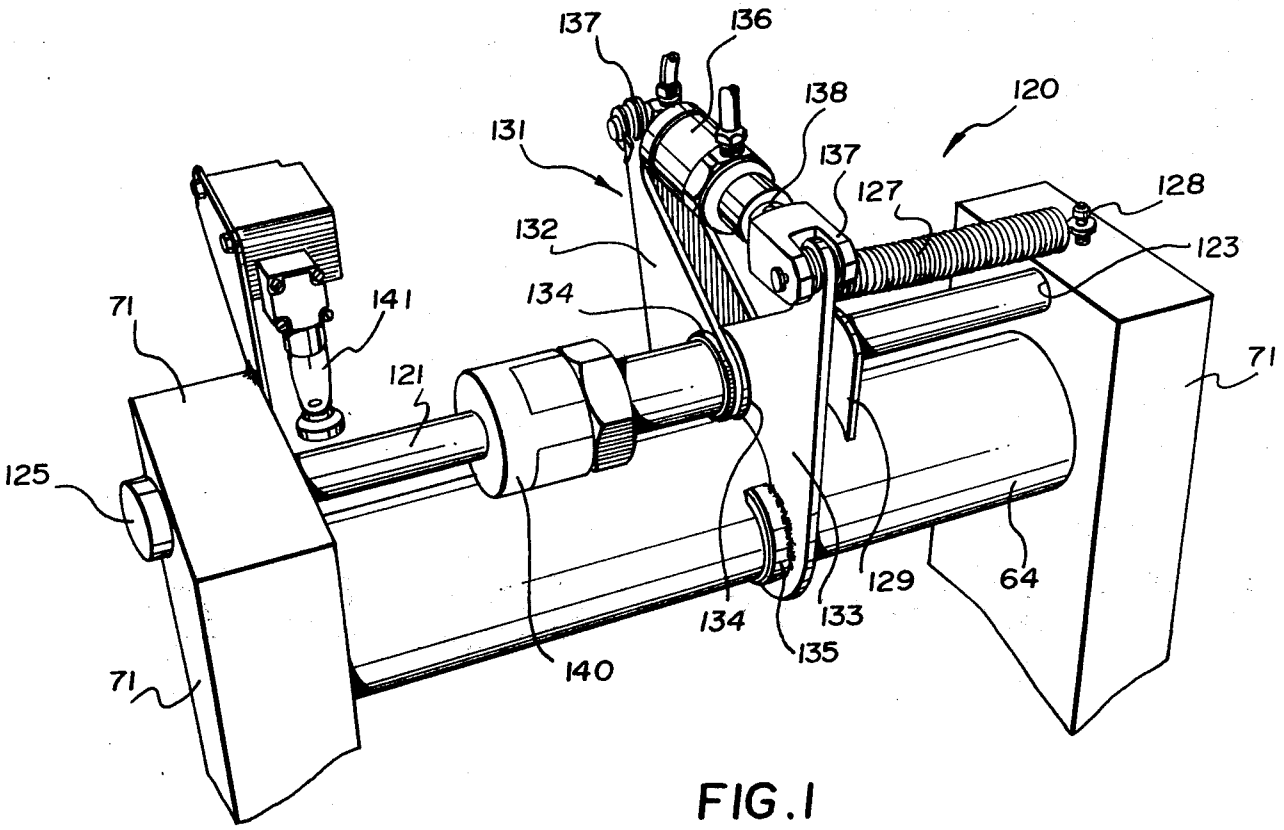
FIG. 1 is a perspective view of a reference mechanism according to the invention.

The Y-reference mechanism, referred to above, is generally referenced 120 in FIGS. 1 to 4. Referring firstly to FIG. 1, the mechanism 120 includes a slim rod 121 which extends parallel to and just above one of the rods 64 along which the Y-frame 65 slides. The rod 121 is received loosely in two holes 123 provided respectively in the bushings 71 of the Y-frame 65. The rod 121 has a head 125 which limits movement of the rod 121 to the right as seen in FIG. 1. A very strong tension spring 127 extends between a screw 128 carried on top of one of the bushings 71 and a plate 129 rigidly mounted on the rod 121. The spring 127 urges the rod 121 to its extreme right hand position, as seen in FIG. 1, in which the head 125 bears against the left hand bushing 71. The right hand end portion of the rod 121 is seen to protrude beyond the right hand bushing.

Approximately centrally, the rod 121 carries a "tongs" arrangement 131 which includes two generally triangular members 132 and 133 extending outwardly from diametrically opposed locations on the rod 121. Both members 132 and 133 are fixed in the longitudinal direction of the rod 121 by suitable locking members 134 but are free to pivot circumferentially with respect to the rod 121 at least over a small arc. As can be seen the member 132 is formed of two spaced plates and the member 133 as a single plate extending from a point between the plates of member 132.

The lower end of each member 132 and 133 carries a similar arcuate gripping pad 135 spaced closely adjacent the circumferential surface of the rod 64 along which the Y-frame slides. The shape of the pads 135 conforms to that of the rod 64. A pneumatic cylinder 136 is mounted between the upper ends of the members 132 and 133, pivotal connections 137 being provided at the interconnections of the cylinder and the member 132 and of the piston 138 and the member 133. It should be appreciated that as the piston 138 moves out of the cylinder 136 the tops of the members 132 and 133 are pushed apart, the members 132 and 133 rotating in opposite senses until the pads 135 grip the rod 64.

The rod 121 also carries an abutment 140 serving as an actuator for a limit switch 141 mounted on the left hand bushing 71.

The distance between the abutment 140 and the limit switch 141 is substantially equal to the distance between the finger 112 and the central axis of the setter 57 and drive head 58. Thus, when the rod 121 is clamped to the rod 64 on sensing of a hole, the distance between the limit switch 141 and the abutment 140 is travelled by the drive head before it is over the hole.

Operation of the Y-reference mechanism 120 will now be described with reference to FIGS. 2–4 in which the setter 57, head 58 and hole feeler 94 are shown schematically to indicate their respective positions corresponding to different positions of the Y-reference mechanism.

In FIG. 2, the Y-frame 65 is about to begin its sweep (to the right in FIGS. 2–4).

As the Y-frame moves the feeler 94 engages a hole in the tie plate 13 a little later as shown in FIG. 3. Because of the stiffness of the spring 127, the Y-reference mechanism 120 moves along with the Y-frame 65 without relative movement. As indicated above, the extension and retraction of the finger 112 operates a microswitch. This causes actuation of the cylinder 136 which immediately causes clamping of the gripping pads 135 on the rod 64. The rod 121 is now fixed to the rod 64 and as the Y-frame 65 continues its rightward travel the spring 127 is extended as the limit switch 141 approaches the abutment 140 on the now stationary rod 121 until the position shown in FIG. 4 is reached.

In the FIG. 4 position the switch 141 has just been actuated by the abutment 140 causing de-energization of the cylinder 70 driving the Y-frame 65. The Y-frame is now stopped with the setter 57 and drive head 58 aligned over the tie plate hole.

Although a mechanical feeler has been described, it should be clear that the reference mechanism of the invention could operate satisfactorily on a signal from an electro-optical hole sensor or other type of non-tactile sensor.

What is claimed is:

1. A machine for applying fastening members to rail tie plates to secure rails to ties, the machine comprising a frame, a sensor on said frame for sensing a fastening member location on the tie plate, and a drive head on said frame for applying a fastening member at the fastening member location, at least one guide rod on which the frame is mounted for movement parallel to the rails, means connected to said frame for moving the frame parallel to the rails in a direction in which the sensor leads the drive head, a reference mechanism on the frame and including clamping means connected to said sensor and operable on sensing by the sensor of the fastening member location to move from an unclamped condition to a clamped condition in which the reference mechanism is clamped to the guide rod, and switch means connected to said means for moving the frame and comprising a first component carried by the reference mechanism and a second interacting component carried by the frame, the switch means being operable on interaction of the first and second components to de-energize the means for moving the frame, the spacing between the first and second components in the unclamped condition of the reference mechanism being related to the spacing between the sensor and the drive head for causing the frame to continue its travel until the drive head is positioned above the fastening member location at which point the frame stops due to re-energization of the means for moving the frame.

2. A machine according to claim 1 further comprising a further rod on which the clamping means is carried and extending parallel to said guide rod, said further rod being slidably supported on the frame, and a spring connected between said further rod and said frame for causing said frame and said further rod to normally move conjointly, the clamping means normally being free of the guide rod and being operable on sensing by the sensor of a fastening member location to clamp the guide rod for fixing said further rod relative to said guide rod.

3. A machine according to claim 2 in which the axial spacing between the sensor and the drive head is substantially equal to the spacing between the first and second components of the switch means in the unclamped condition of the reference mechanism.

4. A machine according to claim 1 further comprising holding means for a fastening member also mounted on said frame, the holding means being located adjacent the sensor and having means for holding a fastening member under the drive head.

5. A machine according to claim 4 in which the axial spacing between the sensor and the drive head is substantially equal to the spacing between the first and second components of the switch means in the unclamped condition of the reference mechanism.

6. A machine according to claim 4 further comprising a further rod on which the clamping means is carried and extending parallel to said guide rod, said further rod being slidably supported on the frame, and a spring connected between said further rod and said frame for causing said frame and said further rod to normally move conjointly, the clamping means normally being free of the guide rod and being operable on sensing by the sensor of a fastening member location to clamp the guide rod for fixing said further rod relative to said guide rod.

7. A machine according to claim 1 in which the sensor is a hole sensor for sensing a hole in a tie plate and the drive head comprises means for driving a spike through that hole and into the tie.

8. A machine according to claim 7 in which the hole sensor is a mechanical sensor having a feeler which when received in a hole causes operation of the reference mechanism.

9. A machine according to claim 8 in which the axial spacing between the sensor and the drive head is substantially equal to the spacing between the first and second components of the switch means in the unclamped condition of the reference mechanism.

* * * * *